US006047145A

United States Patent [19]

Shigezaki et al.

[11] Patent Number: 6,047,145

[45] Date of Patent: Apr. 4, 2000

[54] IMAGE FORMING DEVICE AND IMAGE FORMING METHOD

[75] Inventors: Satoshi Shigezaki; Taichi Yamada, both of Minami-Ashigara; Yutaka Agawa; Toshio Masubuchi, both of Iwatsuki, all of Japan

[73] Assignee: Fuji Xerox Co., Ltd., Tokyo, Japan

[21] Appl. No.: 08/984,991

[22] Filed: Dec. 4, 1997

[30] Foreign Application Priority Data

Dec. 9, 1996 [JP] Japan ..... 8-328476

[51] Int. Cl.[7] ..... G03G 15/02

[52] U.S. Cl. ..... 399/50; 399/176

[58] Field of Search ..... 399/50, 174, 175, 399/176

[56] References Cited

U.S. PATENT DOCUMENTS 5,450,180 9/1995 Ohzeki et al. ..... 399/50
5,568,232 10/1996 Kashihara ..... 399/50

FOREIGN PATENT DOCUMENTS

A-1-204081 8/1989 Japan .
A-2-39169 2/1990 Japan .
A-2-134670 5/1990 Japan .
A-3-48870 3/1991 Japan .
A-4-76571 3/1992 Japan .

*Primary Examiner*—Arthur T. Grimley
*Assistant Examiner*—William A. Noē
*Attorney, Agent, or Firm*—Oliff & Berridge, PLC

[57] ABSTRACT

An image forming apparatus of the present invention includes at least an image carrier and a contact type charging device. The image forming apparatus further includes a control control device that controls the contact type charging device so as to apply DC voltage having the same polarity as the charging polarity of the image carrier to the image carrier at the same time that or before rotation of the image carrier begins and successively applies a voltage in which AC voltage is superimposed on the DC voltage at the same time that or after the DC voltage is applied and at the latest after the rotation of the image carrier begins. Therefore, according to the present invention, electrostatic memory in the image carrier is prevented, so that the occurrence of black stripe or the like corresponding to a contact point of the contact type charging device is prevented, thereby enabling formation of high quality images.

9 Claims, 7 Drawing Sheets

IMAGE FORMING DEVICE AND IMAGE FORMING METHOD

BACKGROUND OF THE INVENTION

1. Field of the Invention

This invention relates to an electrophotographic apparatus using a contact type charging device as a charging means, an image forming apparatus such as an electrostatic recording apparatus, and an image forming method using the contact type charging device as a charging means.

2. Description of the Related Art

Conventionally, a corona discharger which is a non-contact type charging device or the like has been used widely as a charger which charges an image carrier such as an electrophotographic photoconductor or the like. In recent years, the contact type charging devices have been used for the reasons of space saving, low cost, simplicity of power source, generation of less ozone and the like. As the contact type charging device, for example, a charging roller is well known, in which a conductive rubber layer is formed on a conductive core material and a protective layer is formed on the conductive rubber layer. This conductive rubber layer is put into contact with the image carrier under a predetermined pressure so as to charge the image carrier equally.

However, because the contact type charging device is directly in contact with the image carrier, the following problems arise depending on the materials of the conductive rubber layer and protective layer and production conditions thereof. That is, if a contact type charging device left for a long time under high temperatures and humidity in a fresh condition without contamination with toner is utilized to form images, a black stripe may occur corresponding to a contact position of the contact type charging device.

The reason why this problem arises is thought to be that because the contact type charging device is in firm contact with the image carrier at a predetermined pressure, low-molecular weight compounds inside the conductive rubber layer seep outside the protective layer and the surface layer is plastically deformed or the like, so that fitting between the image carrier and contact type charging device increases. When both the components are separated from each other, exchange of charges occurs therebetween. Further, if a charge having an opposite polarity to the charging potential polarity (hereinafter sometimes referred to as charging polarity) of the image carrier is loaded on the image carrier, the charge is injected/trapped (hereinafter sometimes referred to as electrostatic memory) in a bulk direction so that the charging characteristic or photo-sensitivity of the image carrier changes at positions in firm contact with the contact type charging device, thereby causing differences in density and half-tone images in particular.

Therefore, reduction of seepage of low-molecular weight compounds from the conductive rubber layer by appropriately selecting materials and the thickness of the protective layer or reduction of seepage of the low-molecular weight compound from the conductive rubber layer by appropriately selecting materials of the conductive rubber layer and the protective layer production conditions such as vulcanization conditions are worthy of consideration. However, in these cases, such inconveniences as charging failure are produced because of increased resistance in the contact type charging device, reduced freedom in selection of materials for providing the contact type charging device with its proper function, and reduced production efficiency because production process control becomes more difficult.

Further, although separation of the contact type charging device from the image carrier when not in the image forming cycle and separation of the image carrier from the contact type charging device using a spacer when not in use have been proposed, these proposals induce complicated structures thereby leading to increase of production costs.

The present invention has been proposed to solve the aforementioned problems of the prior art and it therefore is an object of the invention to provide an image forming method which, while maintaining freedom of selection of materials of the contact type charging device as a charging means, and selection of production processes, can prevent securely electrostatic memory to the image carrier due to exchange of charge caused when the contact type charging device is separated from the image carrier, so as to prevent securely an occurrence of black stripe or the like corresponding to a contact position of the contact type charging device, thereby enabling the formation of high quality images, and an image forming apparatus of a simple structure having the aforementioned functions.

SUMMARY OF THE INVENTION

According to an aspect of the present invention, there is provided an image forming apparatus comprising: a charging means for charging an image carrier; an image exposure means for exposing so as to form images; a developing means for performing reversal development, a transfer means for carrying out transfer of images; and a control means for controlling these operations in which the control means controls the charging means so as to apply DC voltage having the same polarity as a charging polarity of the image carrier to the image carrier at the same time that or before a rotation of the image carrier begins and successively apply a voltage in which AC voltage is superimposed on the DC voltage at the same time when or after the DC voltage is applied.

According to another aspect of the invention, there is provided an image forming method containing a step for forming a toner image on the image carrier and a step for transferring the toner image to a transfer material, in which the DC voltage having the same polarity as the charging polarity of the image carrier to the image carrier is applied at the same time that or before the rotation of the image carrier begins and the voltage in which the AC voltage is superimposed on the DC voltage is applied at the same time that or after the DC voltage is applied.

DESCRIPTION OF THE PREFERRED EMBODIMENTS

An image forming method of the present invention includes at least a step for forming a toner image on an image carrier (hereinafter referred to as "image forming process") and a step for transferring the toner image onto a transfer material (hereinafter sometimes referred to as "transfer process"). The image forming method of the present invention can be achieved preferably using an image forming apparatus of the present invention.

The image forming apparatus of the present invention comprises an image carrier, image exposure means, charging means, developing means, transfer means and control means, and further a known fixing means is provided as required.

Hereinafter, the embodiments of the image forming method and image forming apparatus employing the present invention will be described in detail.

Figure 1:
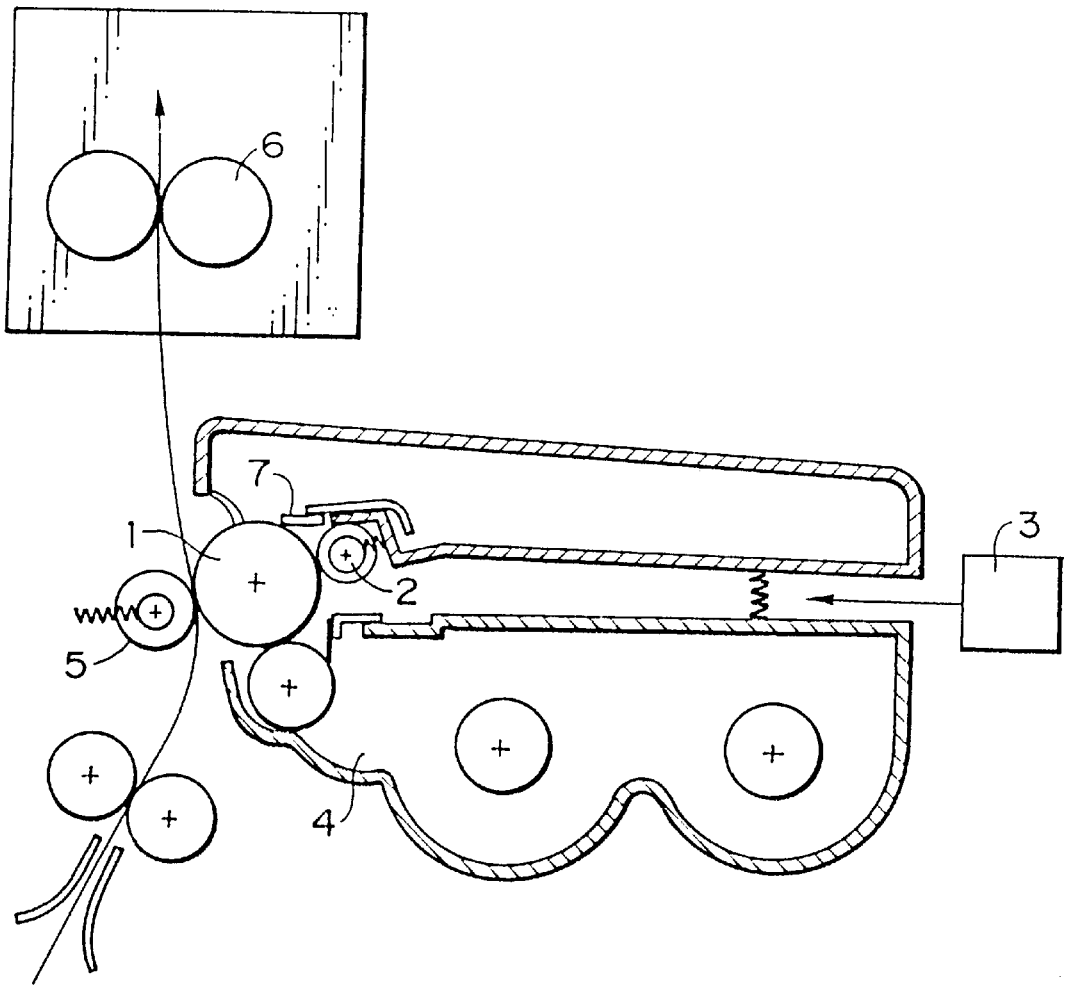
FIG. 1 is a schematic sectional view of an image forming apparatus according to the present invention.

FIG. 1 shows an embodiment of an image forming apparatus of the present invention. This image forming apparatus comprises a photoconductor 1 which is an image carrier, a charging roll 2 which is a contact type charging device as a charging means, an image exposure device 3 which is an image exposure means, a developer 4 which is a developing means, a transfer roll 5 which is a transfer charging device as a charging means, a cleaner 7, a fixing device 6 which is a fixing means and a control means which controls the operations of these components.

The image forming process is a step in which at least charging, image exposure and developing are carried out for the image carrier. This image forming process can be executed preferably using the image carrier, the contact type charging device, the image exposure device, the developing device and the like in the image forming apparatus of the present invention.

The image carrier is not limited to any particular type in terms of its material, shape, structure, size and the like and any appropriate formation can be selected depending on its purpose. As a preferable example thereof, electrophotographic photoconductors, electrostatic latent image carriers and the like, which are already well known, can be mentioned. The image carrier in the image forming apparatus shown in FIG. 1 is a drum-like photoconductor 1.

The charging refers to the operation of applying an appropriately selected voltage to the surface of the carrier so as to charge that surface with electricity. A known contact type charging device having, for example, a conductive or semiconductive roll, brush, film, rubber blade or the like can be selected to carry out the charging. The contact type charging device has a function of applying the image carrier with DC voltage and/or AC voltage by changing charging timing, duration, strength and the like as desired.

The image forming apparatus of the present invention has such a contact type charging device. The contact type charging device of the image forming apparatus shown in FIG. 1 is a charging roll 2, which is capable of applying DC voltage and/or AC voltage to the photoconductor 1 which is the image carrier. The photoconductor 1 is charged equally by this charging roll 2.

As for charging according to the image forming method and image forming apparatus of the present invention, it is necessary to apply a voltage to the surface of the image carrier with particular timing. Namely, just when or before the image carrier begins its rotation, a DC voltage of the same polarity as the charging polarity of the image carrier needs to be applied thereto.

The timing control on application of the voltage can be preferably carried out using the control means of the image forming apparatus of the present invention. The control means has a function of controlling the contact type charging device so as to apply a DC voltage of the same polarity as the charging polarity of the image carrier to the image carrier just when or before the image carrier starts its rotation and to further apply a superimposed AC voltage to the DC voltage just when or after the DC voltage is applied. This control means is not restricted to any particular type but can be selected depending on the purpose. For example, a sequencer, computer or the like can be applied. The control means in the image forming apparatus shown in FIG. 1 is not represented in the figure.

According to the present invention, the timing for applying voltage to the surface of the image carrier may be any of the above timing can be selected depending on the purpose. Some examples of the timing are shown below.

FIGS. 3 to 6 show timing charts of the current-carrying sequence of the contact type charging device. In other words, these figures show timing for applying voltage to the image carrier in the contact type charging device.

Figure 3:
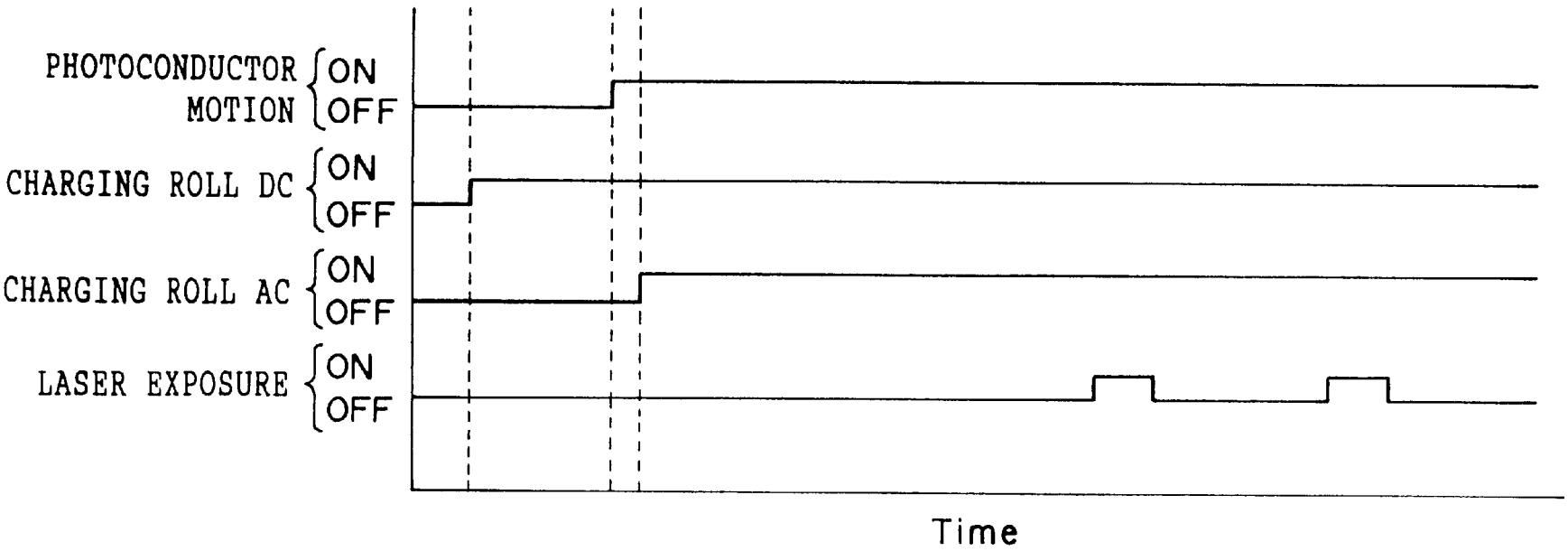
FIG. 3 is an example of a timing chart of current-carrying sequence in the contact type charging device of the present invention.
Figure 4:
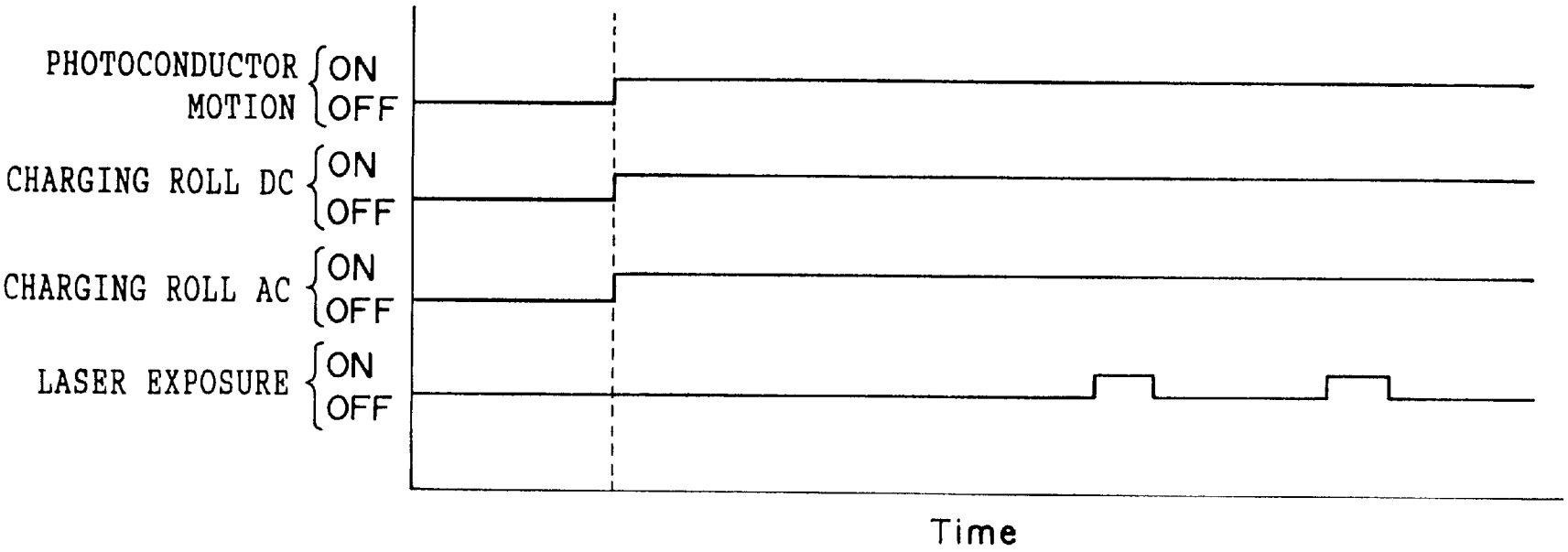
FIG. 4 is an example of a timing chart of current-carrying sequence in the contact type charging device of the present invention.
Figure 5:
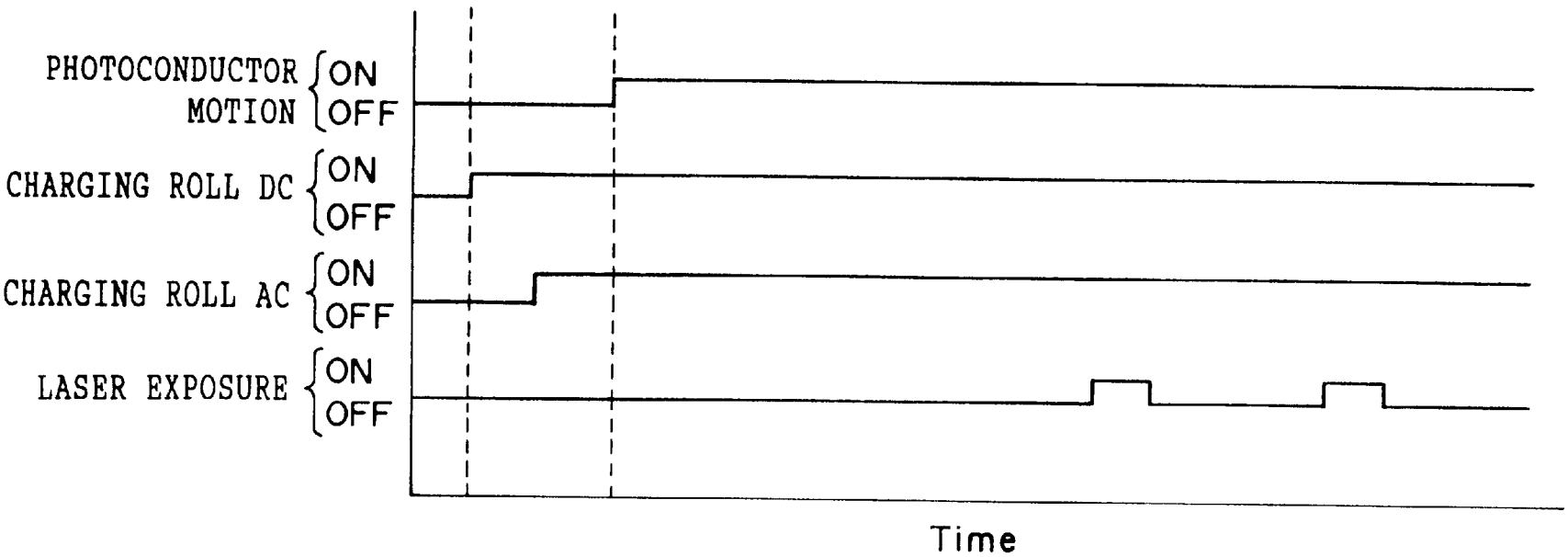
FIG. 5 is an example of a timing chart of current-carrying sequence in the contact type charging device of the present invention.
Figure 6:
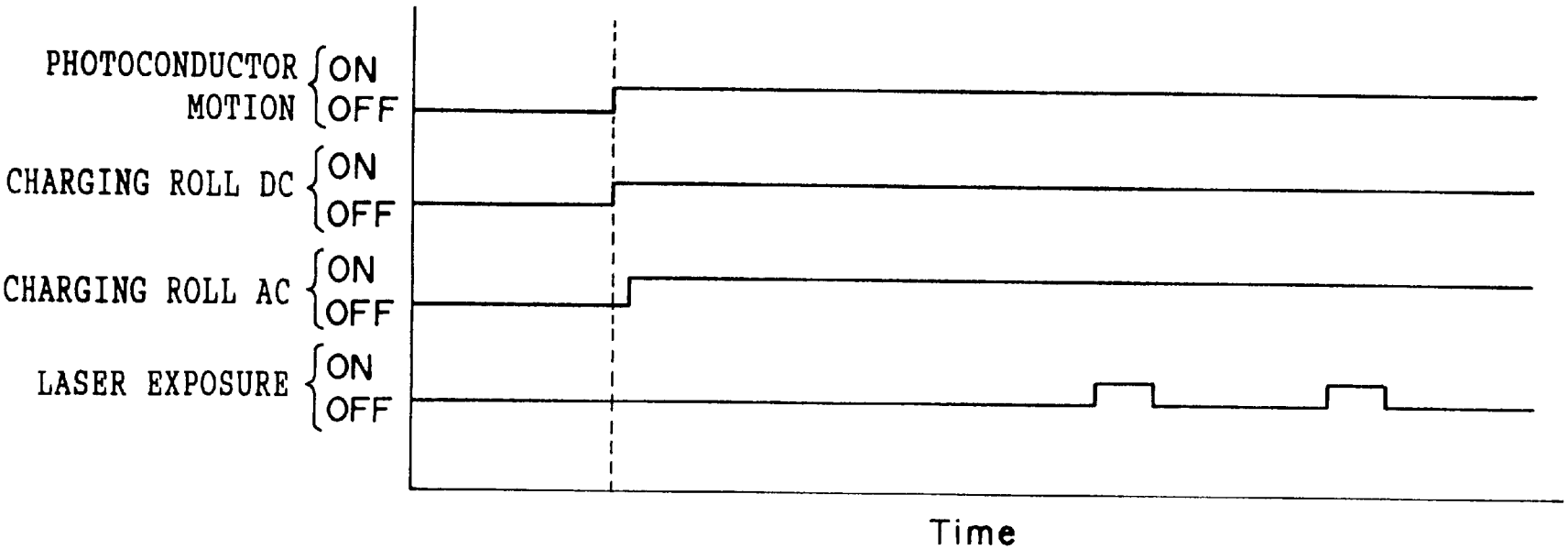
FIG. 6 is an example of a timing chart of current-carrying sequence in the contact type charging device of the present invention.

Referring to FIGS. 3 and 5, the image carrier (photoconductor) is charged with DC voltage before the image carrier begins its rotation. In FIGS. 4 and 6, just when the image carrier begins its rotation to separate the image carrier (photoconductor) from the contact type charging device (just when the image carrier (photoconductor) and the contact type charging device begin relative motion), namely just when the image carrier (photoconductor) begins its rotation, DC voltage is applied to the image carrier (photoconductor).

The polarity of DC voltage to be applied at this time is the same as the charging polarity of the image carrier. Although the magnitude of the DC voltage depends on the kind, purpose and the like of the image carrier and cannot be specified generally, it can be appropriately selected within a range not harming the effect of the present invention.

The surface of the image carrier used in image forming cycle has a slight amount of adhering toner which is not removed by a cleaning member (cleaner 7 in the image forming apparatus shown in FIG. 1) such as a cleaning blade or the like. This toner works as a spacer so that equal direct contact between the image carrier and the contact type charging device is hampered. Thus, "rotation for separating the image carrier and contact type charging device" means a rotation of the image carrier in an ordinary image forming cycle. However, in the present invention, the rotation is not restricted thereto but includes a rotation of the image carrier as a warm-up or the like at the time of startup of the image forming apparatus, in particular, an initial rotation of the image carrier in a new, clean condition without adhesion of toner or the like.

When DC voltage is applied to the image carrier at the aforementioned timing, an electric field for preventing injection of charge into the image carrier is formed in the image carrier so as to suppress injection of charges into the image carrier. As a result, electrostatic memory in the image carrier due to charge exchange which occurs when the contact type charging device is separated from the image carrier can be prevented securely. This prevents the occurrence of black stripe corresponding to a contact position of the contact type charging device, thereby preventing effectively a reduction of image quality so as to form high quality images.

According to the present invention, the image carrier and/or the contact type charging device may be provided undetachably from the image forming apparatus or detachably therefrom. In the latter case, as the image carrier and contact type charging device, for example, cartridge type (formed as a cartridge) can be used. When the cartridge type image carrier and contact type charging device are used, by applying DC voltage to the image carrier at least at the aforementioned timing at the initial rotation of the image carrier after the contact type charging device is replaced, electrostatic memory to the image carrier can be prevented securely.

When the aforementioned cartridge image carrier and contact type charging device are used, it is permissible to provide a detecting means for detecting whether or not the cartridge type image carrier and contact type charging device mounted on the image forming apparatus are actually in use, so as to detect a first rotation of the image carrier after the contact type charging device is replaced.

The detecting means is not restricted to any particular one but selectable from known commercial products, so that a detecting means mounted on an image forming apparatus such as a commercially marketed electrophotographic apparatus can be preferably used. For example, it is permissible to provide a detachable cartridge with an unvolatile memory and capable of writing and then providing the image forming apparatus with a device capable of reading/writing from/into that memory. Such a device can be used as the aforementioned detecting means.

If such a detecting means is mounted on the image forming apparatus, that detecting means detects whether or not the contact type charging device is in use, so that DC voltage can be applied to the image carrier at least at the aforementioned timing at the first rotation of the image carrier after the contact type charging device is replaced. Even if the detecting means is not equipped on the image forming apparatus, it is possible to apply DC voltage to the image carrier at the aforementioned timing when the cartridge type image carrier and contact type charging device are removed or the image forming apparatus is actuated.

Formation of an electric field at the time of the separating rotation of the image carrier and contact type charging device is sometimes very difficult if a difference between products in starting response of a rotary motor of the image carrier and a power supply of the contact type charging device is considered. In such a case, as shown in FIG. 3 or 5, it is preferable to apply DC voltage to the image carrier earlier than at the separating rotation of the image carrier and contact type charging device. Consequently, even if there is a difference between the products in the starting response of the rotary motor of the image carrier and the power supply of the contact type charging device, injection of charges into the image carrier is prevented so that any electrostatic memory in the image carrier is prevented securely, thereby preventing effectively a reduction of image quality.

Applying DC voltage to the image carrier just when or before the rotation for separating the image carrier and contact type charging device is started means application of DC voltage to the image carrier in a static state. If the image carrier is formed of material having a low insulating performance, the insulation of the image carrier may be destroyed. Then, in such a case, the DC voltage to be applied by the contact type charging device varies with time. That is, initially a low DC voltage is applied to the image carrier at the time of separating rotation and, when an image is formed (printed), it is switched to normal DC voltage. Consequently, even if the image carrier made of material having a low electric insulating performance is used, the insulation of the image carrier is not destroyed. Thus, injection of charges into the image carrier is prevented so that electrostatic memory to the image carrier is prevented securely thereby preventing effectively a reduction of image quality. Further, by changing the DC voltage applied to the image carrier over time, damage of the image carrier due to destruction of insulation, discharge such as sputtering and the like can be reduced.

According to the present invention, the contact type charging device applies DC voltage to the image carrier and after that, the contact type charging device applies AC voltage to the image carrier. When the AC voltage is applied thereto, the DC voltage has been already applied to the image carrier. Therefore, that image carrier has the DC voltage and AC voltage which are superimposed on each other.

According to the present invention, the timing in which the AC voltage is applied to the image carrier from the contact type charging device must be the same time as or after the DC voltage is applied thereto. The AC voltage may be applied before the image carrier begins its rotation or at the same time that or after the image carrier begins its rotation also as long as it is applied at the same time that or after the DC voltage is applied. As a concrete example of the former case, the AC voltage is applied at a timing shown in FIG. 5. As a concrete example of the latter case, the AC voltage is applied at a timing indicated in FIGS. 3, 4 and 6.

Although the magnitude of the AC voltage differs depending on the kind of the image carrier, purpose and the like and cannot be determined generally, it can be appropriately selected within a range not harming the effect of the present invention.

A relation between the timing of application of the DC voltage and AC voltage to the image carrier and the timing of rotation of the image carrier according to the present invention will be described below.

If DC voltage having the same polarity as the charging polarity of the image carrier is applied to the image carrier before rotation of the image carrier, and after application of the DC voltage and rotation of the image carrier, the AC voltage is applied so as to be superimposed on the DC voltage, the following points are advantageous.

In this case, it is possible to suppress effectively injection of positive (plus) charges into the image carrier due to exchange of separation charge between the contact type charging device and image carrier. Further, it is possible to avoid effectively physical damage and electric damage of the image carrier which may be caused by application of the AC voltage in such a condition that the image carrier is static (concretely, physical damage by sputtering and electric damage such as destruction of insulation can be avoided effectively). Further, the surface energy of the image carrier due to application of the AC voltage increases, thereby preventing effectively bad influences upon cleaning performance and the like. Consequently, the service life of the image forming apparatus can be extended.

In a case when DC voltage having the same polarity as the charging polarity of the image carrier is applied before the rotation of the image carrier to the image carrier, and after the application of the DC voltage and before the rotation of the image carrier, AC voltage is applied so as to be superimposed on the DC voltage, the following points are advantageous.

In this case, it is possible to suppress effectively injection of positive (plus) charges to the image carrier which is caused by exchange of separation charges between the contact type charging device and image carrier.

In a case when DC voltage and AC voltage having the same polarity as the charging polarity of the image carrier are applied simultaneously at the time of or before rotation of the image carrier to the image carrier, the following points are advantageous.

In this case, it is possible to suppress effectively injection of positive (plus) charges to the image carrier which is caused by exchange of separation charges between the contact type charging device and image carrier. Further, because application control for the DC voltage and AC voltage does not have to be carried out separately, control on the image forming apparatus is easy.

In the image forming method and image forming apparatus of the present invention, the DC voltage and AC voltage are applied to the image carrier in the above described manner, and then the image carrier is exposed to images by the image exposure means. Concretely, as shown in FIGS. 3 to 6, after application of DC voltage and AC voltage to the image carrier is started, the image exposure means is actuated so as to expose the image carrier to the images.

The exposure of images is an operation for forming electrostatic latent images by exposing the images on the surface of the charged image carrier corresponding to the image to be formed. This can be achieved by using a known image exposure means which us e s a known light source such as semiconductor laser beam, LED beam, liquid crystal shutter beam and the like.

The image forming apparatus of the present invention is equipped with such image exposure means. The image exposure device of the image forming apparatus shown in FIG. 1 is the image exposure device 3, which functions by exposing the photoconductor 1 (the image carrier) to laser beams through irradiation, so as to form electrostatic latent images on the photoconductor 1. Therefore, the photoconductor 1 is exposed images by the image exposure device 3, so that an electrostatic latent image corresponding to a desired image is formed on the surface.

In the image forming method and image forming apparatus of the present invention, after an electrostatic latent image is formed on the image carrier in the above described manner, the electrostatic latent image is developed using the developer. The aforementioned development is an operation of developing the electrostatic latent image using an electrostatic image developing agent of the present invention. For example, this can be achieved whether the developing agent is in contact with or not in contact with the electrostatic latent image by using a developer having a function of developing the electrostatic latent image. The aforementioned developer is not restricted to any particular type as long as the aforementioned function is possessed, and any type can be selected appropriately depending on the purpose. Thus, it may be a single-color developer or a multi-color developer.

The developing agent to be contained in the developer may be a one component system developing agent made of toner or a two-component system developing agent containing toner and a carrier. Although the toner is not restricted to any particular type, black toner is generally used for single-color developing, and color toner selected from magenta, yellow and cyan in addition to black toner is used for multi-color developing. For full color, black toner, magenta toner, yellow toner and cyan toner are used.

The image forming apparatus of the present invention contains the developer. The developer in the image forming apparatus shown in FIG. 1 is a developer 4 for single color, which contains black toner internally. By putting this black toner in contact with the aforementioned electrostatic latent image by means of a rotary roll, that latent image is developed. As a result, the electrostatic latent image formed on the surface of the photoconductor 1 is developed by this developer 4 so that a toner picture is formed on the surface.

The aforementioned transfer process is a step for transferring the toner image onto a transfer material. This transfer step can be preferably executed using a transfer charging device of the image forming apparatus of the present invention.

The transfer can be carried out through non-contact transfer by corona discharge, transfer belt, contact transfer by a transfer roller or the like by using a known transfer charging device or the like. The image forming apparatus of the present invention contains the transfer charging device. The transfer charging device of the image forming apparatus shown in FIG. 1 is the transfer roll 5 which is a contact type charging device. This transfer roll 5 has the function of forming an electric field and transferring the toner image from the photoconductor 1 to the transfer material. By an operation of this transfer roll 5, the toner image on the photoconductor 1 is transferred to the transfer material.

The transfer material is not restricted to any particular type but various known commercially marketed copy paper and the like are available.

In the image forming method and image forming apparatus of the present invention, the fixing can be carried out. This fixing can be carried out using a known fixing device such as, for example, a thermal roller fixing device. The image forming apparatus of the present invention contains the fixing device. The fixing device of the image forming apparatus shown in FIG. 1 is the fixing device 6 of thermal roll type, which has a function of thermally fixing the toner image transferred to the transfer material on the same transfer material. By an operation of the fixing device 6, the toner image on the photoconductor 1 is fixed firmly on the transfer material.

Experiments based on the image forming apparatus and image forming method of the present invention will be described.

(Experiment 1)

The image forming apparatus used in experiment 1 is the image forming apparatus shown in FIG. 1, that is, a laser printer.

This image forming apparatus comprises the photoconductor 1 which is the image carrier, the charging roll 2 which is the charging means, the image exposure device 3 which is the image exposure means, the developer 4 which is the developing means, the transfer roll 5 which is the transfer means, the fixing device 6 which is the fixing means, the cleaner 7 and the control device (not shown) which is the control means.

In this image forming apparatus, the charging roll 2 is in contact with the organic photoconductor 1 at a predetermined pressure such that it is driven and applies DC voltage and AC voltage at a timing shown in FIG. 3 according to a signal from the control device. The photoconductor 1 is charged equally with negative polarity by the operation of the charging roll 2. At this time, because electric field blocking injection of charges into the photoconductor 1 is formed on the photoconductor 1, injection of charges into the photoconductor 1 is suppressed. Consequently, electrostatic memory in the photoconductor 1 due to charge exchange which occurs when the charging roll 2 is separated from the photoconductor 1 is prevented securely. Next, the image exposure device 3 exposes the charged photoconductor 1 to images so as to form electrostatic latent images on the photoconductor 1. The electrostatic latent image is developed by the developer 4 using a developing agent containing toner, so that the toner image is formed on the photoconductor 1. The toner image formed on the photoconductor 1 is transferred to transfer paper by the transfer roll 5. The toner image transferred to the transfer paper is thermally fixed by the fixing device 6. The developing agent remaining on the photoconductor 1 after the transfer is cleaned by the cleaner 7. As a result, high quality images are always formed without generating black stripe corresponding to contact between the photoconductor 1 and charging roll 2.

Figure 2:
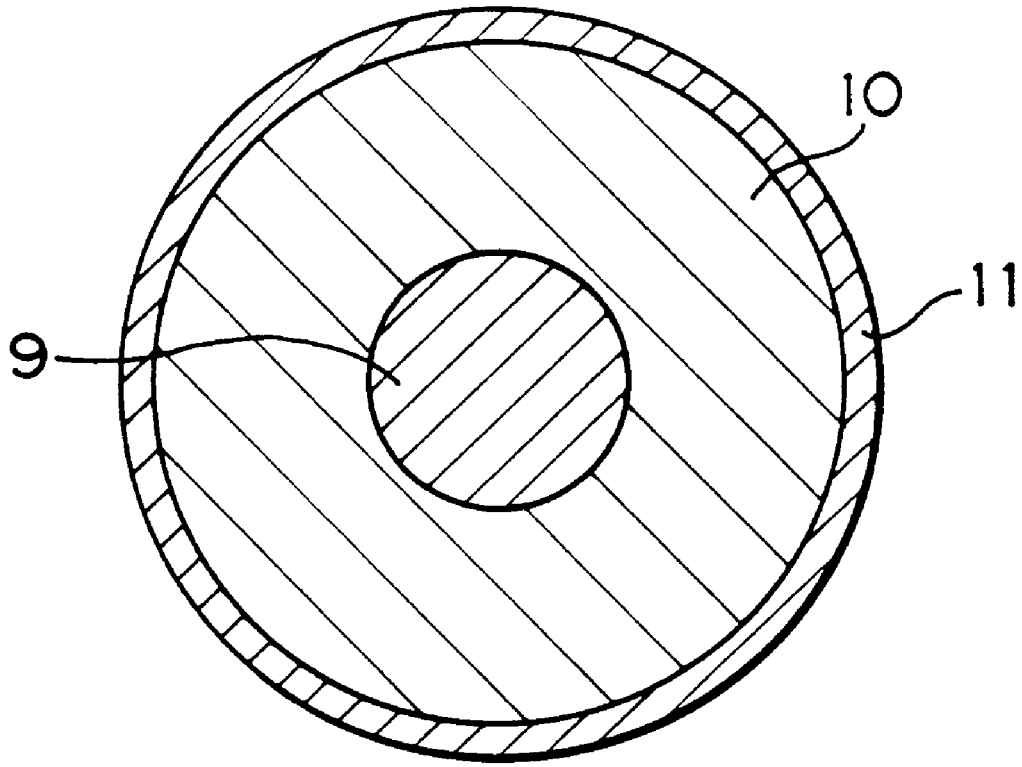
FIG. 2 is a schematic sectional view of a charging roll for use as a contact type charging device in the image forming apparatus of the present invention.

In the image forming apparatus, the charging roll 2 comprises, as shown in FIG. 2, a charging roll core 9, a conductive rubber layer 10 coated thereon and a surface protective layer 11 which is the topmost layer coated thereon. The charging roll 2, photoconductor 1, developer 4 and cleaner 7 are designed in cartridge fashion and easily detachable from the image forming apparatus. The photoconductor 1 and charging roll 2 are contained in a single cartridge.

This image forming apparatus is provided with a detecting means (not shown) for detecting whether or not the cartridge type charging roll 2 is in use. This detecting means is designed so as to detect a first rotation of the photoconductor 1 after replacement of the charging roll 2. Further, the detecting means transmits to the control means a signal detecting whether or not the charging roll 2 is in use. The control means applies DC voltage and AC voltage to the photoconductor 1 at a timing shown in FIG. 3 at the time of the first rotation of the photoconductor 1 after the replacement of the charging roll 2.

In the first embodiment, the aforementioned image forming apparatus stored at below 43° C. and 90% RH for 168 hours and not dirty with toner and a new cartridge containing the photoconductor 1 and charging roll 2, were used. The current-carrying timing for the charging roll 2 was based on a sequence shown in FIG. 3, as described above. Under such conditions, a print (image formation) test was performed and it was seen whether or not an image fault (black stripe) was caused on the circumference of the photoconductor 1 at a position which the charging roll 2 was in contact with when the cartridge was stored.

From the charging roll 2 to the photoconductor 1, only −250 V DC voltage was applied from 1,000 ms before rotation of the photoconductor 1 until 50 ms after the rotation began. From 50 ms after the rotation of the photoconductor began, a DC voltage of −430 V superimposed on an AC voltage of 1,800 Vp-p, the voltage conditions for ordinary printing, was applied.

As a result, when charging according to the sequence shown in FIG. 3 was carried out, image fault (black stripe) at the circumference of the photoconductor at the position which the charging roll 2 was in contact with at the time of storage of the cartridge did not occur. Further, 20,000 print tests were executed in the same sequence. As a result, no fault such as destruction of insulation in the photoconductor 1 occurred. Excellent image quality maintenance was obtained.

In the first embodiment, DC voltage having the same polarity as the charging polarity of the photoconductor 1 was applied to the photoconductor 1 before the rotation of the photoconductor 1, and after the application of the DC voltage and after the rotation of the photoconductor 1 began, a voltage in which the AC voltage was superimposed on the DC voltage was applied. Therefore, it is possible to suppress effectively injection of positive (plus) charges into the photoconductor 1, which is caused by exchange of separation charges between the charging roll 2 and photoconductor 1. Further, it is possible to avoid effectively physical damage and electric damage of the photoconductor 1 resulting from application of the AC voltage in a condition in which the photoconductor 1 rests (concretely, physical damage due to factors like sputtering and electric damage, and destruction of insulation can be effectively avoided). Further, the surface energy of the photoconductor 1 due to application of the AC voltage increases thereby preventing effectively bad influences upon cleaning performance or the like.

(Experiment 2)

Print (image formation) test was carried out in the same manner as Experiment 1 except that the charging timings were changed to the sequence timing and voltage conditions shown in FIGS. 4 to 6 and Table 1. As a result, image fault (black stripe) on the circumference of the photoconductor 1 at a position which the charging roll 2 was in contact with at the time of storage of the cartridge did not occur.

When, as a timing for the aforementioned charging, the timing of a sequence shown in FIG. 4 was used, that is, when DC voltage and AC voltage having the same polarity as the charging polarity of the photoconductor 1 were applied simultaneously to the photoconductor 1 at the time when the rotation of the photoconductor 1 began, injection of positive (plus) charges to the photoconductor 1 caused by exchange of separation charges between the charging roll 2 and photoconductor 1 could be effectively prevented. Further, because application control for the DC voltage and AC voltage did not have to be made separately, control of the image forming apparatus was easy.

If, as a timing of the charging, the timing of a sequence shown in FIG. 5 was used, that is, if DC voltage having the same polarity as the charging polarity of the photoconductor 1 was applied to the photoconductor 1 before the rotation of the photoconductor 1 began and after the application of the DC voltage and before the rotation of the photoconductor 1 began, a voltage in which AC voltage was superimposed on the DC voltage was applied, it was possible to suppress effectively injection of positive (plus) charges to the photoconductor 1 resulting from exchange of separation charge between the charging roll 2 and photoconductor 1.

If, as a timing of the charging, the timing of a sequence shown in FIG. 6 was used, that is, if DC voltage having the same polarity as the charging polarity of the photoconductor 1 was applied to the photoconductor 1 at the same time when the rotation of the photoconductor 1 began and after the application of the DC voltage, a voltage in which AC voltage was superimposed on the DC voltage was applied, it was possible to suppress effectively injection of positive (plus) charges to the photoconductor 1 resulting from exchange of separation charge between the charging roll 2 and photoconductor 1.

TABLE 1

| | Charging roll current-carrying timing | | Application voltage on charging roll | |
|---|---|---|---|---|
| | DC voltage | AC voltage | DC voltage | AC voltage |
| FIG. 4 | ON at the same time that photoconductor is actuated. | ON at the same time that photoconductor is actuated. | −430 V | 1800 Vp-p |
| FIG. 5 | ON 1,000 ms earlier than when photoconductor is actuated. | ON 500 ms earlier than when photoconductor is actuated. | −430 V | 1800 Vp-p |
| FIG. 6 | ON at the same time that photoconductor is actuated. | ON 50 ms after photoconductor is actuated. | −430 V | 1800 Vp-p |

(Comparative Experiment 1)

Figure 7:
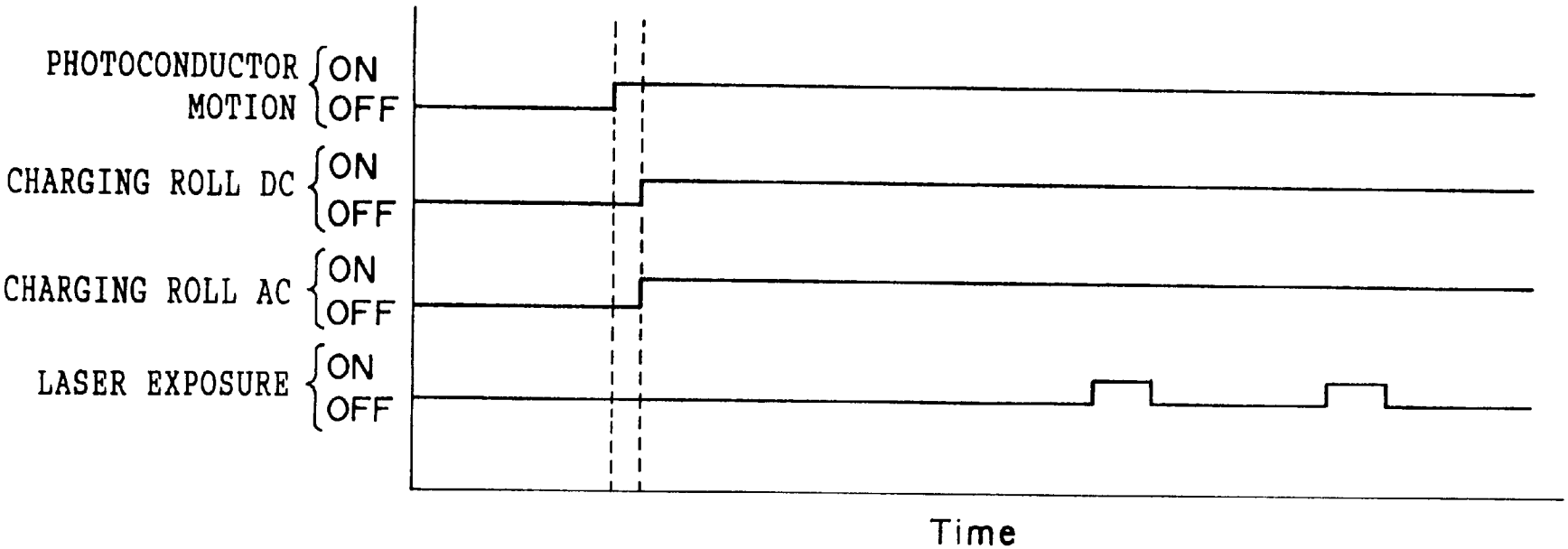
FIG. 7 is a comparative example of a timing chart of current carrying sequence of a charging roll.

A print (image formation) test was carried out in the same manner as Experiment 1 except that the charging timing was changed to the timing of a sequence shown in FIG. 7. As a result, image fault (black stripe) occurred on the circumference of the photoconductor 1 at a position which the charging roll 2 was in contact with at the time of storage of the cartridge.

According to the present invention, long term problems can be solved. Further, according to the invention, the freedom in selection of material of the contact type charging device which is the charging means and freedom in selection of production process can be secured. Further, electrostatic memory in the image carrier due to the exchange of charges which occurs when the contact type charging device is separated from the image carrier is prevented completely, so that an occurrence of black stripe or the like corresponding to a contact position of the contact type charging device is prevented securely. Therefore, the present invention can provide an image forming method capable of forming a high quality image and an image forming apparatus of a simple structure having such a function.

What is claimed is:

1. An image forming apparatus comprising: a charging means for charging an image carrier; an image exposure means for exposing so as to form images; a developing means for performing reversal development, a transfer means for carrying out transfer of images; and a control means for controlling these operations, wherein said control means controls said charging means so as to apply DC voltage having the same polarity as a charging polarity of said image carrier to said image carrier before rotation of said image carrier begins and applies a voltage in which AC voltage is superimposed on said DC voltage after said DC voltage is applied and before the rotation of said image carrier.

2. An image forming apparatus according to claim 1, wherein rotation of the image carrier begins when any one of said image carrier or charging means is mounted or removed or when non-use of any one thereof is detected.

3. An image forming apparatus according to claim 1, wherein said control means controls the operation of said charging means so that the DC voltage is varied over time.

4. An image forming method containing a step for charging an image carrier, a step for forming toner image on an image carrier and a step for transferring said toner image to a transfer material, wherein a DC voltage of the same polarity as a charging polarity of said image carrier is applied to said image carrier before rotation of said image carrier begins and then a voltage having an AC voltage superimposed on said DC voltage is applied after said DC voltage is applied and before rotation of said image carrier begins.

5. An image forming method according to claim 4, wherein the DC voltage is varied over time.

6. An image forming apparatus comprising: a charging means for charging an image carrier; an image exposure means for exposing so as to form images; a developing means for performing reversal development, a transfer means for carrying out transfer of images; and a control means for controlling these operations, wherein said control means controls said charging means so as to apply DC voltage having the same polarity as a charging polarity of said image carrier to said image carrier before rotation of said image carrier begins and applies a voltage in which AC voltage is superimposed on said DC voltage after said DC voltage is applied and after the rotation of said image carrier.

7. An image forming apparatus according to claim 6, wherein rotation of the image carrier begins when any one of said image carrier or charging means is mounted or removed or when non-use of any one thereof is detected.

8. An image forming apparatus according to claim 6, wherein said control means controls the operation of said charging means so that the DC voltage is varied over time.

9. An image forming method containing a step for charging an image carrier, a step for forming toner image on an image carrier and a step for transferring said toner image to a transfer material, wherein a DC voltage of the same polarity as a charging polarity of said image carrier is applied to said image carrier before rotation of said image carrier begins and then a voltage having an AC voltage superimposed on said DC voltage is applied after said DC voltage is applied and after rotation of said image carrier begins.

* * * * *